United States Patent [19]

Duty

[11] Patent Number: 5,044,699

[45] Date of Patent: Sep. 3, 1991

[54] TOTE BAG WITH STRAPS

[76] Inventor: Carolyn Duty, 3028 Bridlewood, Franklin, Tenn. 37064

[21] Appl. No.: 535,378

[22] Filed: Jun. 8, 1990

[51] Int. Cl.[5] ..... B65D 33/06

[52] U.S. Cl. ..... 383/37; 190/108

[58] Field of Search ..... 383/2, 4, 37; 190/108; 150/111

[56] References Cited

U.S. PATENT DOCUMENTS

| | | | |
|---|---|---|---|
| 584,870 | 6/1897 | Giugliano | 190/107 |
| 954,840 | 4/1910 | Wiedemann | 383/4 |
| 1,606,107 | 11/1926 | Simms | 382/2 |
| 1,636,838 | 7/1927 | Roser | 383/2 |
| 1,729,318 | 9/1929 | Wunderlich | 383/2 |
| 4,170,282 | 10/1979 | Schwartzstein | 190/108 |
| 4,206,835 | 6/1980 | Shapiro | 190/108 |
| 4,436,189 | 3/1984 | Baum | 190/108 |
| 4,854,431 | 8/1989 | Pulichino | 190/108 |

*Primary Examiner*—Stephen P. Garbe

*Attorney, Agent, or Firm*—Stephen T. Belsheim

[57] ABSTRACT

A tote bag capable of being in at least two conditions. When in the first condition, the volume of the bag is accessible. When in the second condition, the bag is compacted. The bag is made of pliable material. A keeper member for keeping the bag in the second condition is attached to the bag. When in the second condition, it is in rolled-up form with a secondary tote bag rolled up inside.

10 Claims, 2 Drawing Sheets

TOTE BAG WITH STRAPS

BACKGROUND OF THE INVENTION

This invention relates generally to tote bags, and in particular, a tote bag having straps to secure the bag in a compact, self-contained condition so that the bag is easy to transport and store.

In the past tote bags have been used for a variety of purposes, and particularly, by individuals desiring to transport small items from one place to another. For example, tote bags have been used by individuals to transport and store knitting materials and to transport items such as suntan lotion, towels and radios to and from a beach or lake. More recently, in light of heightened environmental concerns, the use of tote bags by shoppers, in lieu of the conventional paper and plastic shopping bags provided by the store, has been advocated and encouraged. The basic premise is that shoppers, by providing their own reusable shopping bags, will lessen the demand for paper and plastic shopping bags. As a result, fewer trees will need to be cut down to make paper shopping bags and less garbage will be created as a result of paper and plastic shopping bags being disposed of by the shopper after use.

With the advent of the use of tote bags for shopping, one problem faced by shoppers is that of storing and transporting the tote bags while not in use. Typically, the tote bags are made of cloth or some other flexible and durable material. The tote bags are usually stored in the person's home or automobile and then carried into the store. A drawback to using tote bags is that when not in use they can tend to be awkward and cumbersome to transport and store. These problems make the use of such tote bags inconvenient and therefore less desirable. Therefore, it would be highly desirable to provide an improved tote bag that is of a construction so as to be easy and manageable to use.

SUMMARY OF THE INVENTION

It is a basic object of the invention to provide a durable, pliable, reusable tote bag which is easy and convenient to use.

Another object of this invention to provide an attractive, durable tote bag made of flexible, pliable material having a means which is both simple to operate and of simple, inexpensive construction which enables the tote bag to be secured in a condition that is compact and attractive and which facilitates ease in the transportation and storage of the tote bag when the tote bag is not being used.

In one form thereof the invention comprises a bag made of flexible material and a flexible keeper member adapted for keeping the bag in a compact condition.

In another form thereof, the invention comprises a tote bag which is capable of being maintained in two conditions. In the first condition the volume of the tote bag is compacted. The tote bag comprises a bag made of pliable material and a keeper member adapted for keeping the tote bag in the second condition.

Another object of the present invention is to provide a kit containing a plurality of tote bags which can be transported and stored as a unit.

DETAILED DESCRIPTION OF SPECIFIC EMBODIMENTS

Figure 1:
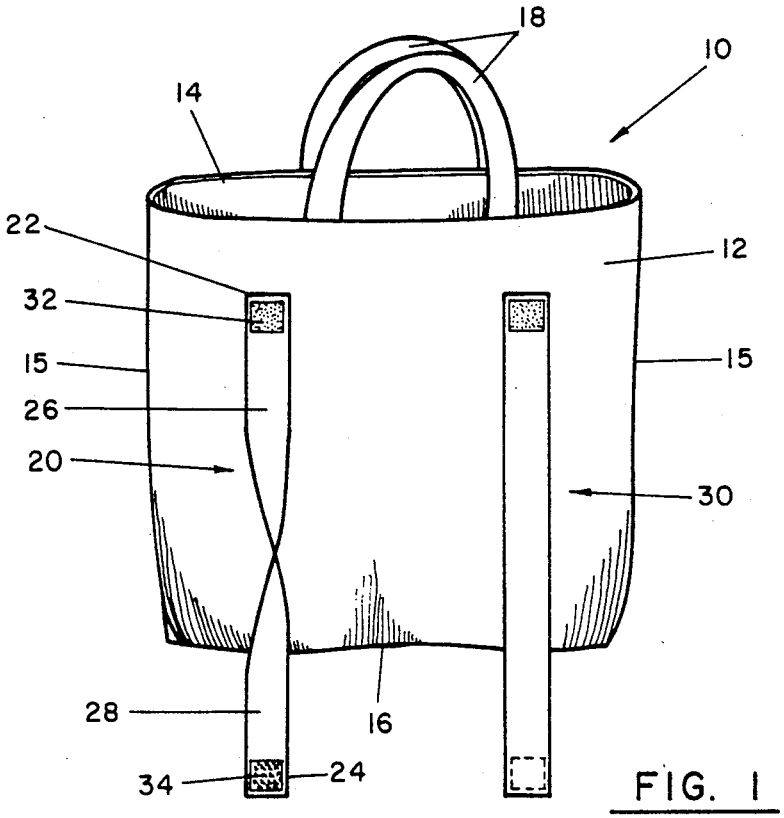
FIG. 1 is a perspective view of one embodiment of the tote bag of the present invention in one condition, having one strap twisted to show the "loops" portion of the "VELCRO" type material.

With reference to the cited drawings, the tote bag 10 of the present invention can be made of a pliable canvas-type material which is both strong and attractive. Tote bag 10 comprises a first panel 12, a corresponding second panel 14, and a bottom panel (not shown). The first panel 12, second panel 14 and bottom panel define the volume of the bag. The first and second panels 12, 14 are generally rectangular and are joined together at their respective sides 15. The first and second panels 12, 14 and all other elements of the bag may be joined or attached together by sewing or other means sufficient to create a permanent seam. The bottom panel is located at the lower end of the tote bag 10, and is attached on a first side to the lower end 16 of the first panel 12 and on a second side to the lower end of the second panel 14. Furthermore, the tote bag 10 is provided with two handles 18. One handle is securely attached at the upper end of each of the first and second panels 12, 14 so as to facilitate the carrying of the tote bag 10.

Tote bag 10 is also provided with a first strap 20 and a second strap 30. The first and second straps 20, 30 are securely attached to the first panel 12 at a location generally toward the upper end and opposite sides 15 of said panel. The first and second straps 20, 30 each have a first end 22 and a second distal end 24. In FIG. 1 a piece of "VELCRO" type material containing hooks 32 is attached to the outer surface 26 of the first end 22 of the strap 20 at the same location 11 where the strap is attached to the first panel 12. A second piece of "VELCRO" type material containing loops 34 is attached to the inner surface 28 adjacent the distal end 24 of strap 20.

Figure 2:
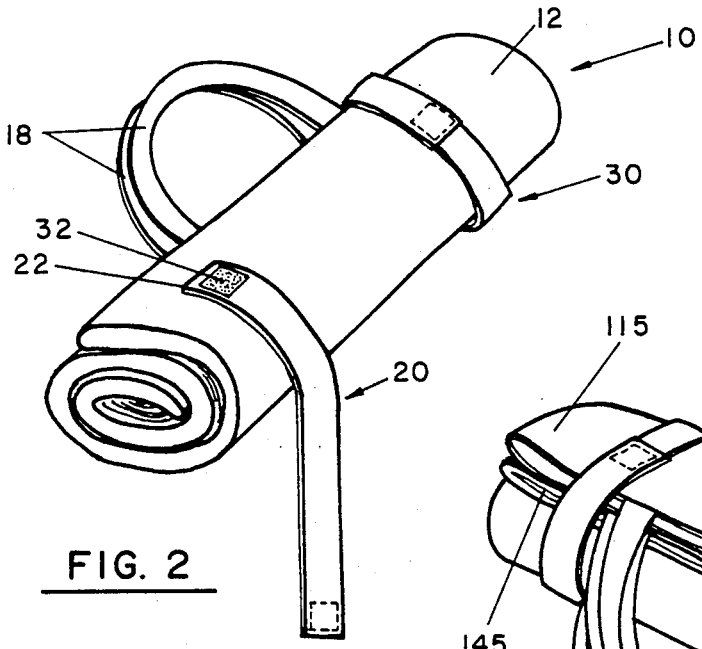
FIG. 2 is a perspective view of the tote bag of FIG. 1 in another condition having one strap secured around the tote bag.

When the tote bag 10 is in use the first and second straps 20, 30 typically loosely hang downward against the bag 10. To place the tote bag 10 in a condition for storage and transportation while not in use, the tote bag 10 is laid flat with the second panel 14 facing downward and the first panel 12 facing upward. The tote bag 10 is rolled, beginning from the bottom end 16 thereof, toward the top end so as to form a generally elongate shape. The tote bag 10 is rolled up to the point where the first and second straps 20, 30 are affixed to the tote bag 10 and so as not to include the straps 20, 30 within the interior of the roll. The top end of the bag which is not included in the roll is folded in the direction of the second panel 14 so that the VELCRO type material 32 of the first and second straps 20, 30 is exposed and facing outwardly of the roll. The first strap 20 is then placed around the circumference of the rolled tote bag 10 and the VELCRO type pieces 32, 34 are detachably engaged so as to form a secure belt around the rolled tote bag 10 (FIG. 2) In the same manner, the second strap 30 is secured around the rolled tote bag 10.

The straps 20, 30 are spaced apart a sufficient distance so as to not interfere with the projection of the handles 18 when the tote bag is in a rolled condition. In the specific embodiments, the straps (20, 30 or 120, 130) are affixed to the bag (10, 110) in such a manner that they are spaced apart a distance that is greater than the distance between the points at which the handles are attached to the bag.

Once in this storage and transportation condition the tote bag 10 can be easily and efficiently stored and transported while not in use and thereby making the use of such tote bags much easier and more manageable.

Figure 3:
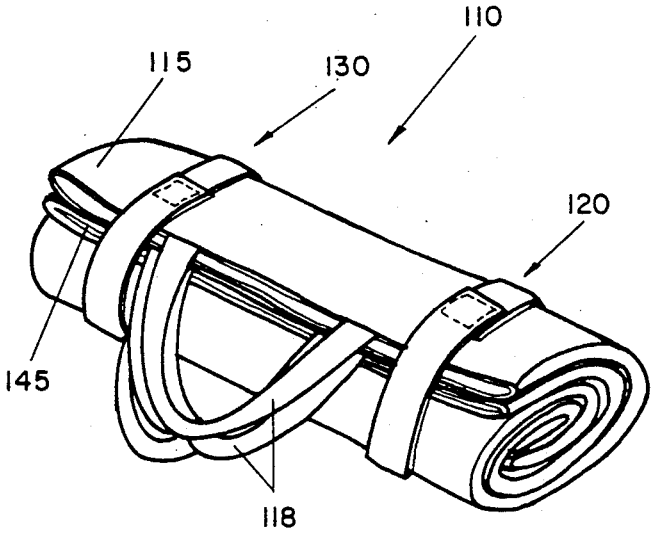
FIG. 3 is a perspective view of an assembly or kit of the present invention wherein a strapless tote bag in a rolled condition is encompassed by a tote bag in a rolled condition with two straps secured about both tote bags.
Figure 4:
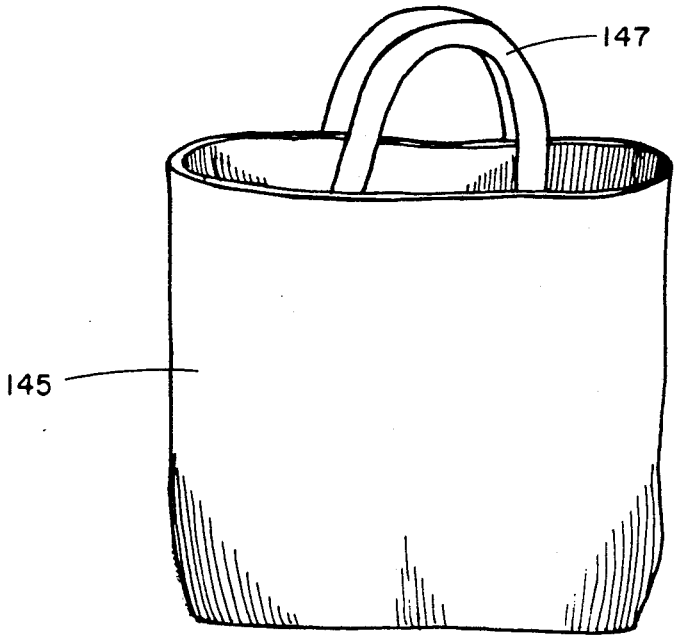
FIG. 4 is a perspective view of a secondary tote bag without straps.

FIG. 3 shows an assembly or kit of the present invention. A kit generally designated as 110 containing a first tote bag 115 and a second tote bag 145 is shown in FIG. 3. Tote bag 115 is structurally the same as tote bag 10 and has straps 120, 130 and handles 118. Straps 120 and 130 have the same features as straps 20 and 30. Tote bag 145 is structurally similar to tote bag 115, except that tote bag 145 does not have straps 120 and 130. Tote bag 145, as illustrated in FIG. 4, has straps 147.

Kit 110 is placed in a condition for storage and transportation by laying tote bag 115 on a horizontal surface so that straps 120, 130 are facing downward and are underneath tote bag 115. Tote bag 145 placed on top of tote bag 115 and aligned with tote bag 145. Tote bags 115 and 145 are rolled together, beginning at the bottom end thereof, toward the top end so as to form a generally elongate shape. Tote bags 115 and 145 are rolled up to the top edge of said bags so that handles 118 are projecting outwardly of said roll and are not included within the interior of the roll. Straps 120, 130 are placed circumferentially around kit 110 similarly as with tote bag 10 described above so as to form a secure belt around kit 110.

It is preferred that only handles 118 of tote bag 115 should project from kit 110. The handles of tote bag 145 (not shown) may or may not be folded so as to be in the interior of the roll of kit 110.

Additional tote bags (not shown) may be included in kit 110 by placing such tote bags on top of tote bag 145 and aligning such tote bag with tote bags 115 and 145 prior to rolling kit 110 into the generally elongate shape.

Figure 5:
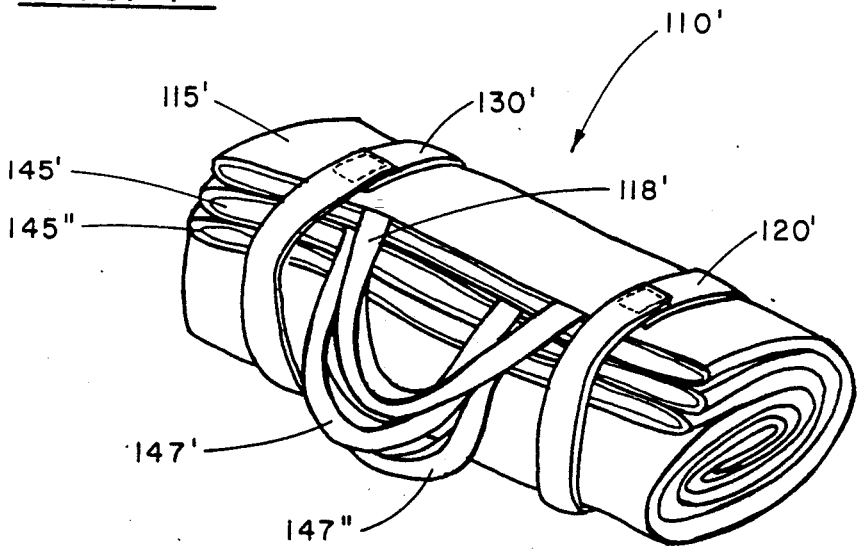
FIG. 5 is a perspective view of an assembly or kit of the present invention wherein two strapless tote bags in a rolled condition are encompassed by a tote bag in a rolled condition with two straps secured about all three bags.

It should be understood that one or more tote bags 145 may be rolled up and then placed on the flat tote bag 115. Tote bag 115, which has straps 120, 130, is rolled up so as to encompass the previously rolled tote bags 145. Straps 120, 130 secure the entire assembly in a rolled condition. Handles 118 permit the assembly to be easily and conveniently transported form location to location. Kit 110 has the advantage that a plurality of tote bags may be kept in a compact condition as a unit. FIG. 5 illustrates an assembly of one tote bag 115' with straps 120' and 130' which encompasses two secondary tote bags 145' and 145". The structure of these secondary tote bags 145', and 145" is the same as that of tote bag 145 illustrated in FIG. 4. The handles 118', 147' and 147" are shown to be outside of the rolled assembly.

It will be understood that modification and variations of the tote bag with closure straps are within the scope of the present invention.

I claim:

1. A tote bag assembly comprising:

a primary tote bag having handles affixed thereto;

a secondary tote bag having handles affixed thereto;

the secondary bag being in a rolled up condition, the primary bag being rolled up to encompass the rolled up secondary bag; and keeper means, affixed to the primary tote bag, for keeping the primary and secondary tote bags in the rolled up condition.

2. The tote bag assembly of claim 1 wherein there are a plurality of secondary bags.

3. The tote bag assembly of claim 1 wherein said keeper means comprises a strap having one end affixed to the primary tote bag.

4. The tote bag assembly of claim 1 wherein the handles of the primary tote bag project from the assemblage of the rolled up primary and secondary tote bags.

5. A tote bag assembly of a primary tote bag and at least one secondary tote bag comprising:

a primary tote bag defining a top opening, the primary tote bag being capable of being in an expanded condition wherein the primary tote bag defines an interior volume that is accessible through the top opening, said primary tote bag being capable of being in a collapsed condition wherein the primary tote bag does not define an interior volume;

the primary tote bag further including a means for fastening the primary tote bag in the collapsed condition;

a secondary tote bag defining a top opening, the secondary tote bag being capable of being in an expanded condition wherein the secondary tote bag defines an interior volume that is accessible through the top opening, said secondary tote bag being capable of being in a collapsed condition wherein the secondary tote bag does not define an interior volume, the structure of the secondary tote bag being essentially the same as that of the primary tote bag, except for absence of the fastener means from the secondary tote bag;

the tote bag assembly being capable of being placed in a portable condition wherein the primary tote bag is collapsed and encircles the collapsed secondary tote bag wherein the fastening means maintains the primary tote bag about the secondary tote bag.

6. The tote bag assembly of claim 5 wherein the primary tote bag includes handles.

7. The tote bag assembly of claim 5 wherein the secondary tote bag includes handles.

8. The tote bag assembly of claim 5 wherein the fastening means includes a strap affixed to the primary tote bag.

9. The tote bag assembly of claim 5 wherein the secondary tote bag is collapsed so as to be in rolled up configuration.

10. The tote bag assembly of claim 9 wherein the primary tote bag is collapsed so as to be rolled up and encircling the rolled up secondary tote bag.

* * * * *